US006601675B2

(12) United States Patent
Gulledge

(10) Patent No.: US 6,601,675 B2
(45) Date of Patent: Aug. 5, 2003

(54) LOCKING FOLDABLE SAWHORSE

(76) Inventor: Donald P. Gulledge, 42 Lansing Dr., Springfield, IL (US) 62703

( * ) Notice: Subject to any disclaimer, the term of this patent is extended or adjusted under 35 U.S.C. 154(b) by 0 days.

(21) Appl. No.: 09/957,286

(22) Filed: Sep. 20, 2001

(65) Prior Publication Data

US 2002/0166725 A1 Nov. 14, 2002

Related U.S. Application Data

(63) Continuation-in-part of application No. 09/851,932, filed on May 10, 2001, now abandoned.

(51) Int. Cl.[7] ..... E04G 1/34
(52) U.S. Cl. ..... 182/153; 182/225
(58) Field of Search ..... 182/153, 155, 182/224, 225, 181.1, 151, 182.4, 186.5, 186.2, 186.1

(56) References Cited

U.S. PATENT DOCUMENTS 3,713,512 A * 1/1973 Reece ..... 182/225 X
4,102,555 A * 7/1978 Tobolski ..... 182/155 X
4,325,463 A * 4/1982 Taylor ..... 182/155
4,429,765 A * 2/1984 Garcia ..... 182/153
4,620,613 A * 11/1986 Albertson ..... 182/153
4,703,830 A * 11/1987 Parker ..... 182/151
4,790,411 A * 12/1988 Ottoson ..... 182/153 X
5,628,382 A * 5/1997 Hill ..... 182/153
5,758,744 A * 6/1998 Forino ..... 182/181.1
6,142,256 A * 11/2000 Dirk, II ..... 182/153
6,164,413 A * 12/2000 Sagol ..... 182/153

* cited by examiner

*Primary Examiner*—Blair M. Johnson
*Assistant Examiner*—Hugh B. Thompson
(74) *Attorney, Agent, or Firm*—Cherskov & Flaynik

(57) ABSTRACT

A folding and self-locking sawhorse comprised of two frames connected by the tops (20) and the middle horizontal brace (24) to create a combination of two opposing forces which product a rigid sawhorse in the open position, but remains collapsible and folds for storage when the two forces are not in opposition. The sawhorse has a clamping top (20) top which can hold items with a compression force created by the expansion force induced by a folding hinged lever (26) against the two side frames. The clamping top (20) accepts tabletops (42) and other items (46) and the locking divergence of the legs (22) can be used to mate the sawhorse with a base (34) for better stability. An alternative embodiment of the locking foldable sawhorse (58) includes one or more beams (57) set upon a beam support structure **(57*a*). The beam support structure (57*a*) includes two sets of two pivotally joined leg top connectors (69) that are attached to four corresponding top ends of four leg members (71) via rivets (61) forcibly inserted through orifices (62). The support structure (57*a*) further includes braces (63) joined to fiberglass legs (71) on each side of the structure (57*a*); and leg bottom connectors (65) attached to bottom ends of the leg members (71)**.

31 Claims, 15 Drawing Sheets

LOCKING FOLDABLE SAWHORSE

This is a Continuation-In-Part Application of prior application Ser. No. 09/851,932 which was filed on May 10, 2001, now abandoned.

BACKGROUND

1. Field of Invention

This invention relates to folding sawhorses, trestles, and the like, referred herein a sawhorses. The purpose of the invention provides for a sawhorse which self locks resulting in a sawhorse that is easy to use, can be made from standard off-the-shelf materials, is very stable without any specialized locking hardware, and has more functional uses than a standard sawhorse.

2. Description of Prior Art

A number of patents issued on various sawhorses relate, however none disclose the features of the present invention. Several disadvantages exist. One such disadvantage is the inability to self-lock without the addition of special hardware or specific manual procedures as illustrated by U.S. Pat. No. 4,756,385 and U.S. Pat. No. 4,429,765.

The invention uses opposing forces to provide a natural self-locking capability, induced by the opening and closing of the sawhorse. The resulting opposition of the two opposing forces produces a fixed and stable sawhorse when opened, without having to tighten or twist or adjust any specialized bolts, pins, ropes, chains or arms.

The ability to use of simple off-the-shelf hinges and screws in the invention make it easy and cheap to manufacture.

Another disadvantage illustrated by U.S. Pat. No. 4,620,613 is the load-bearing requirements placed upon the hinges, which provide the folding capabilities. This invention places the load upon the main structure and only uses hinges mainly for positional alignment of the main structure resulting in a sawhorse, which can withstand heavy usage and loading without failures or excessive wearing of the hinges.

Many other sawhorses illustrate various designs for being foldable or collapsible. These designs require spring loaded bolts or hinges to induce the forces necessary to have the sawhorses close as illustrated in U.S. Pat. Nos. 4,429,765 and 4,620,613. This invention is collapsible without requiring springs and closes automatically upon the release of the opposing forces and lifted from the ground.

Another disadvantage illustrated by U.S. Pat. Nos. 4,756,385, 2,825,606 and 4,620,613 is the ease of use. The present invention can be deployed using one hand and unemployed the same. This makes it easier to use and more convenient. There are no complicated actions or procedures needed to open and lock the invention as well as unlock and collapse the invention. In the unlocked state, the invention tends toward a folded position when carried.

A disadvantage illustrated by U.S. Pat. No. 4,113,056 is the inability to provide a stable work surface free from falling due to drifts in load or work forces. The clamping action of the invention holds or grips materials placed in the jaws. A tabletop with two screws protruding at each end can easily be held by this invention, resulting in a sturdy worktable. The locking jaws make a functional holder. There are many uses for the holding capabilities such as holding a saw for sharpening. The invention can hold guides to ensure materials won't slip or move. The locking feature makes this invention resistant to the affects of unleveled work surfaces and the rigidity doesn't allow creeping.

A disadvantage illustrated by U.S. Pat. Nos 6,021,866, 4,756,385, 4,620,613, 4,429,765, 4,319,663 and 2,825,606 is the restriction to using hand clamps for holding material. The designs of these prior an examples don't provide usable surface shapes for easily using hand clamps to hold work. This invention when in the locked position, maintains a rigid flat top allowing the easy use of commercially available clamps,

SUMMARY

In accordance with the present inventions a sawhorse comprising a trestle structure using two opposing forces to create a locking action made using standard off-the-shelf components where the invention acts like a fixed structured sawhorse while locked and a foldable sawhorse when not locked maximizing it's ease and diversity of use.

OBJECTS AND ADVANTAGES

Accordingly, several objects and advantages of my invention are:

(a) to provide a stable sawhorse that resist moving, closing, creeping or collapsing due to strain while in use;

(b) to provide a folding sawhorse which can be deployed with a single hand and single action and collapsed as easily for compact storage;

(c) to provide a sawhorse that gives excellent function without the need for nothing more also simple hinges with no spring loaded bolts or hinges, no ropes, chains or adjustment arms;

(d) to provide a sawhorse easily manufactured from standard off-the-shelf components and require a minimum amount of material;

(e) to provide a load bearing sawhorse, capable of handling heavy loading without deforming, loosing stability, shifting or causing excessive wear on components;

(f) to provide a sawhorse capable of retaining functionality when used on unleveled work surfaces;

(g) to provide a sawhorse where most load bearing forces are maintained by the main structural members and not the hinges used to allow folding;

(h) to provide a sawhorse based upon, opposing forces to make it a rigid sawhorse without wobble when in use and still be collapsible when not in use;

(i) to provide a sawhorse that is very light weight and easy to carry and move;

(j) to provide a sawhorse with alternative uses by incorporating a set of locking jaws capable of folding many different items or materials;

(k) to provide a sawhorse which can be used to provide a quick and easy assembly of a work surface which can combine with two sawhorses and provide a stable and locked surface that won't wobble of shift with use;

(l) to provide a sawhorse where changes in dimensions won't change the self locking character of the invention when differing sizes are desired;

(m) to provide a sawhorse which can lock into runners to provide resistance and stability to wind and can be used as a barricade or warning device, (n) to provide easy use of guides to hold and maintain material being worked which are easy to position, change and remove.

(p) to provide a sawhorses which can be made of differing materials such as wood, molded plastic or metal and still operate with the same locking forces.

(p) to provide a sawhorse where clamps can be easily used to hold the work.

Further objects and advantages of my invention will become apparent from a consideration of the drawings and ensuing description.

BRIEF DESCRIPTION OF THE DRAWINGS

In the drawings, closely related figures have the same number but different alphabetic suffices.

SOME REFERENCE NUMERALS

Figure 1A:
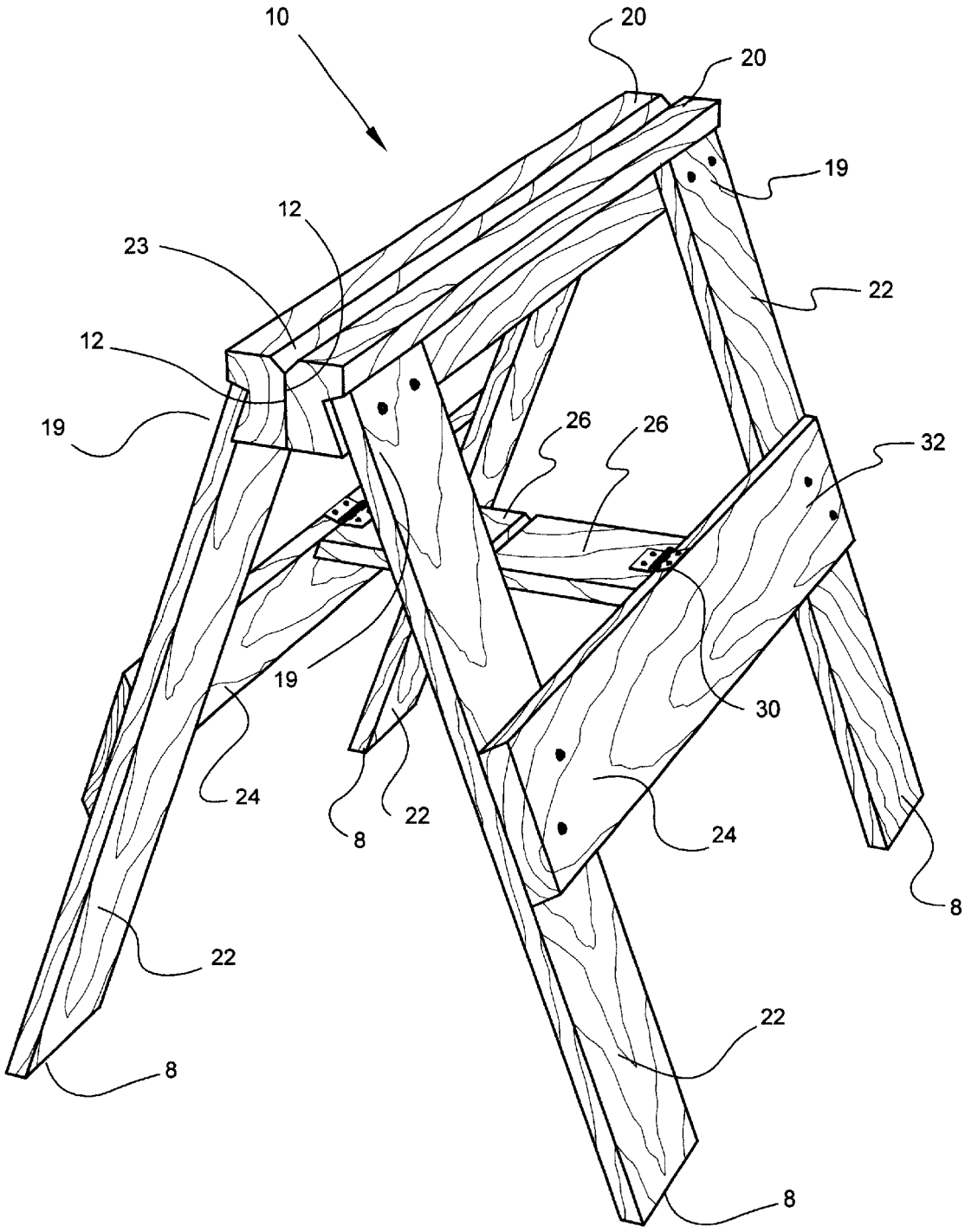
FIG. 1*a* shows a perspective view of the sawhorse.

20 Elongated split beam
21 Grove
22 Vertical member leg
23 Beveled edge
24 Horizontal member brace
25 Beveled edge
26 Hinged locking lever
28 Hinge
30 Small hinge
32 Screw
34 Base
36 Hole
37 Holding pin
40 Holder attached to base
42 Rigid table surface
44 Long screw
46 Hand saw
48 Flat elongated plate
50 Clamp

DESCRIPTION—FIGS. 1, 1A, 1B, 1D, 2, 3A, 3B, 3C and 3D—PREFERRED EMBODIMENT

Figure 1B:
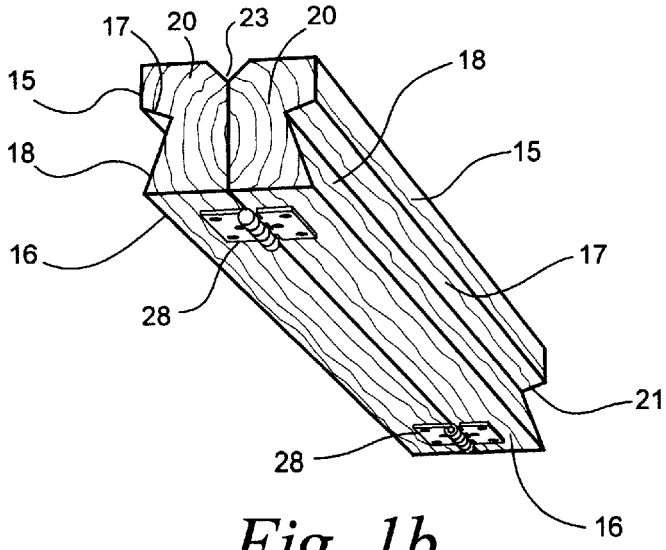
FIG. 1*b* shows the top member of the sawhorse and the locking jaws.
Figure 1C:
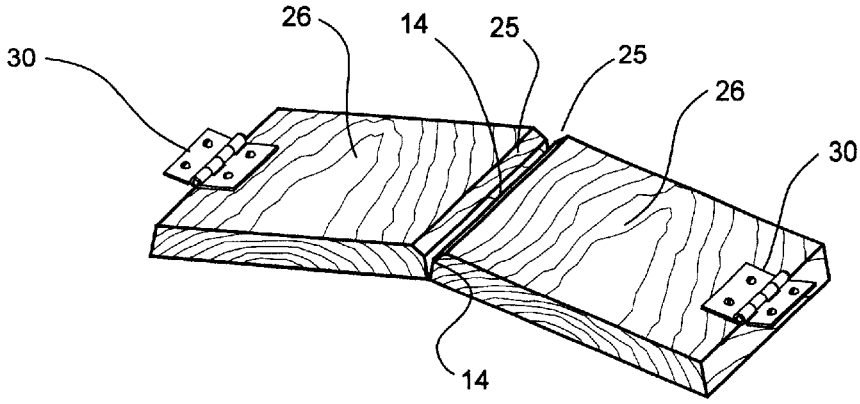
FIG. 1*c* shows the locking hinged lever used to create all opposing force to the top member.
Figure 1D:
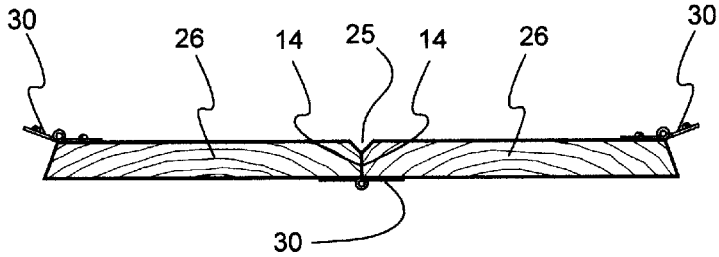
FIG. 1*d* shows a detail of the hinged lever.

A preferred embodiment of the sawhorse of the present invention is illustrated in FIG. 1A (Perspective View), FIG. 1B (Perspective of top member 20) and FIG. 1C (locking lever 26). The sawhorse has two symmetrical sides connected by attachment by the top member 20 as illustrated by FIG. 1B and a locking lever 26 illustrated by FIG. 1C. The top member 20 illustrated in FIG. 1B provides one of the opposing forces while the locking lever 26 shown by FIG. 1C provides a second opposing force necessary to create a rigid locked condition as illustrated by FIG. 1D. The top member 20 acid locking lever 26 each have beveled edges to eliminate pinching while still providing a mating surface necessary for creating the opposing forces.

The top member 20 has two symmetrical parts connected and held by two pivot hinges 28. The opening and closing of the top member 20 allows the folding and unfolding of the two sides and limits the pivotal movement of the aides in the open position. The pivoting action of the locking lever 26 is provided by three hinges as illustrated by FIG. 1C and FIG. 1D.

Figure 3A:
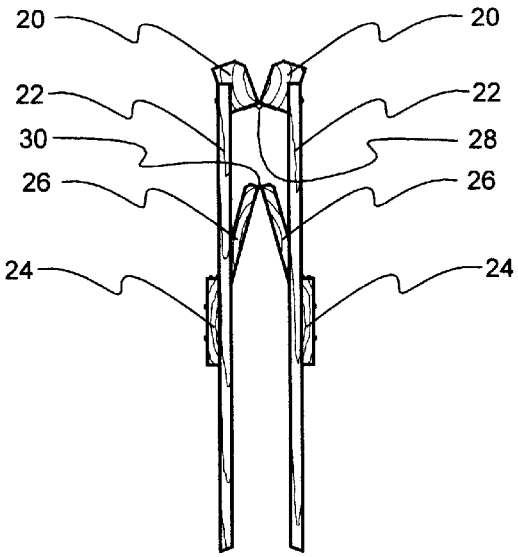
FIG. 3*a* shows an end view of the sawhorse in the unlocked state.
Figure 3B:
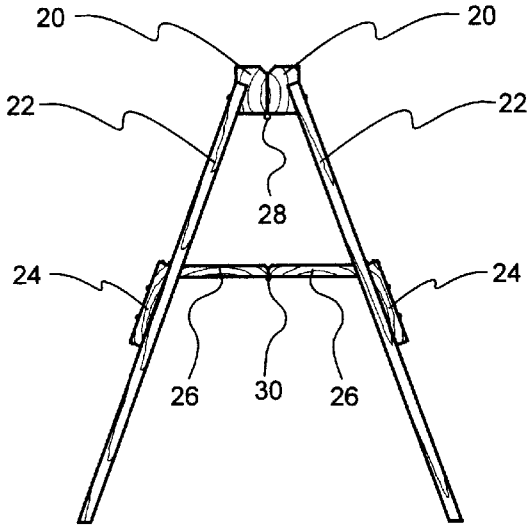
FIG. 3*b* shows an end view of the sawhorse in the locked state.
Figure 3C:
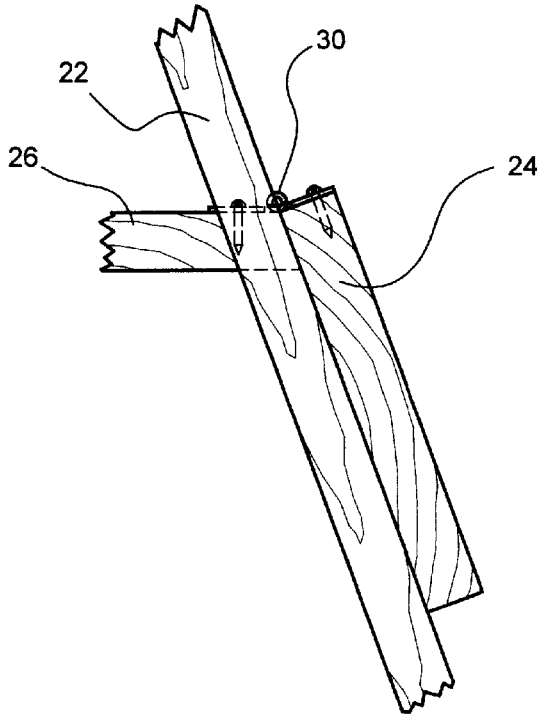
FIG. 3*c* shows a detail view of the sawhorse hinge members joined to the longitudinal side member.

The locking ever 26 abuts a horizontal member 24 illustrated by FIG. 3C. FIG. 3A illustrates the unlocked position of the sawhorse and FIG. 3B shows the locked position. FIG. 3A illustrates the unlocked position of the locking lever 26 and the opened position of the top member 20 whereby the sawhorse pivots to a closed position upon being lifted from a surface. FIG. 3B shows the locked position of member 26 and the closed position of the top member 20 which creates the counter balance of the two opposing forces exerted by the top member 20 and the locking member 26.

Figure 2:
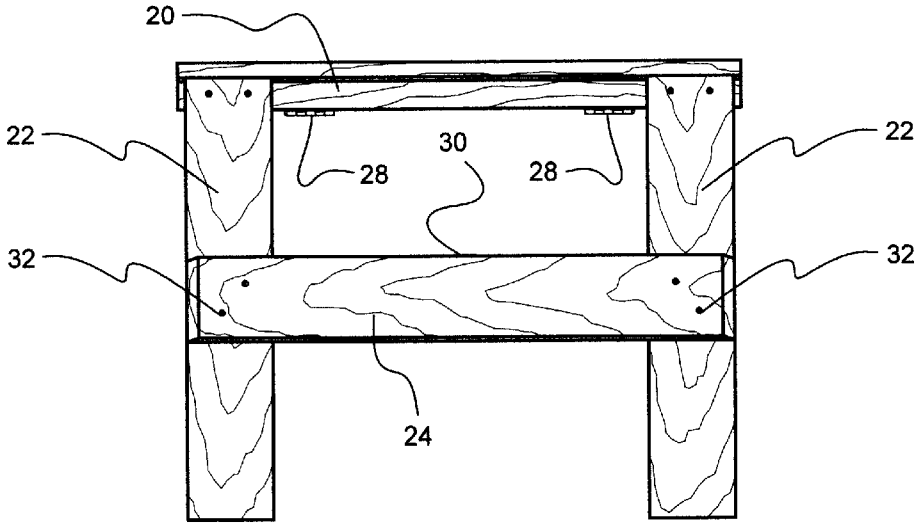
FIG. 2 shows a side view of the sawhorse, which represents both sides since each side is identical.

The side of the sawhorse is comprised of two vertical members 22 and one horizontal brace 24 and the two vertical members are attached to the hinged top members 20 as illustrate in FIG. 2 and attached to the looking lever 26 at the midpoint of the horizontal brace 24 as illustrated by FIG. 3C.

Figure 3D:
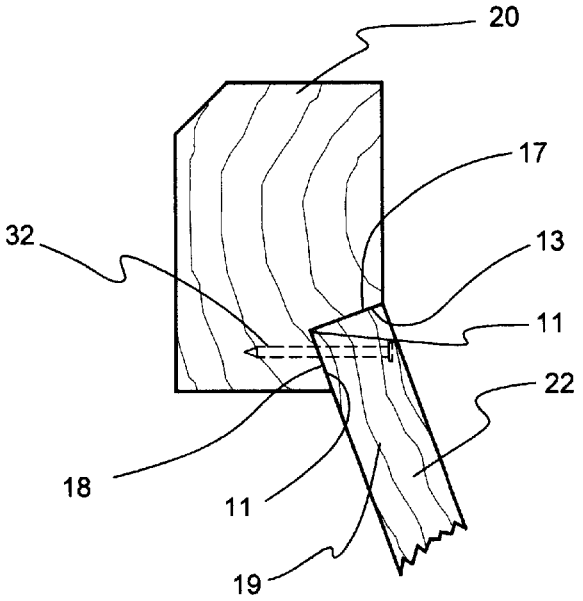
FIG. 3*d* shows a side view of the union of the sawhorse and a leg.
Figure 4:
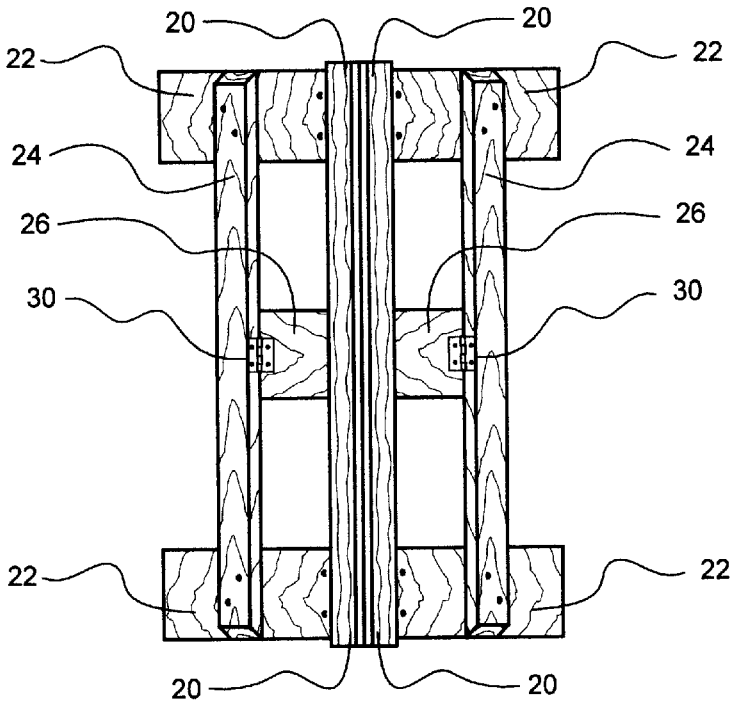
FIG. 4 shows a top view of the sawhorse.
Figure 5:
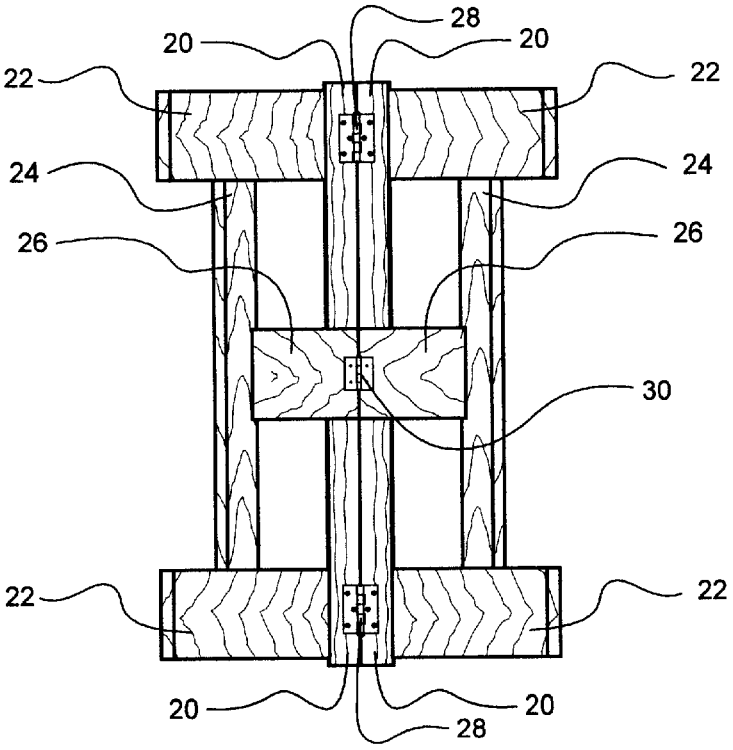
FIG. 5 shows a bottom view of the sawhorse.

The side vertical members 22 abut the top member in the groove 21 on the underside of the top member 20 illustrated by FIG. 3D. The horizontal brace 24 is attached to each of the two side vertical members 22 at each end illustrated in FIG. 2. The horizontal brace 24 and the vertical side member 22 can be the same thickness and width as illustrated in FIG. 2. The locking lever 26 can be the same thickness and width as illustrated in FIG. 1A.

FIGS. 3A, 3B, 3C and 3D—ADDITIONAL EMBODIMENTS

Another embodiment is shown the FIGS. 3C and 3D. The loading of the present invention by placing a load on the top member 20 is maintained by the vertical side members 23 instead of the pivot points. As seen in FIGS. 3A and 3B, the hinges 28 and 30 at the pivot points of this invention-serve to maintain position of the members and not to bear the loads placed upon the top member 20. The load bearing characteristics (if the invention is maximized since the loading is supported directly by the vertical members 22.

In the open and locked position as illustrated by FIG. 3*b*, the invention remains rigid and inflexible due to the compression force of the top member 20 opposing the expansion force of the locking lever 26. The sawhorse remains fixed and rigid while in use exhibiting the same steadiness seen in a non-foldable sawhorse.

The present invention is easy to deploy by the simple looking of the locking lever while remaining light and easy to carry and store as illustrated by FIG. 3A and FIG. 3B.

BRIEF DESCRIPTION OF THE INVENTION

Figure 6A:
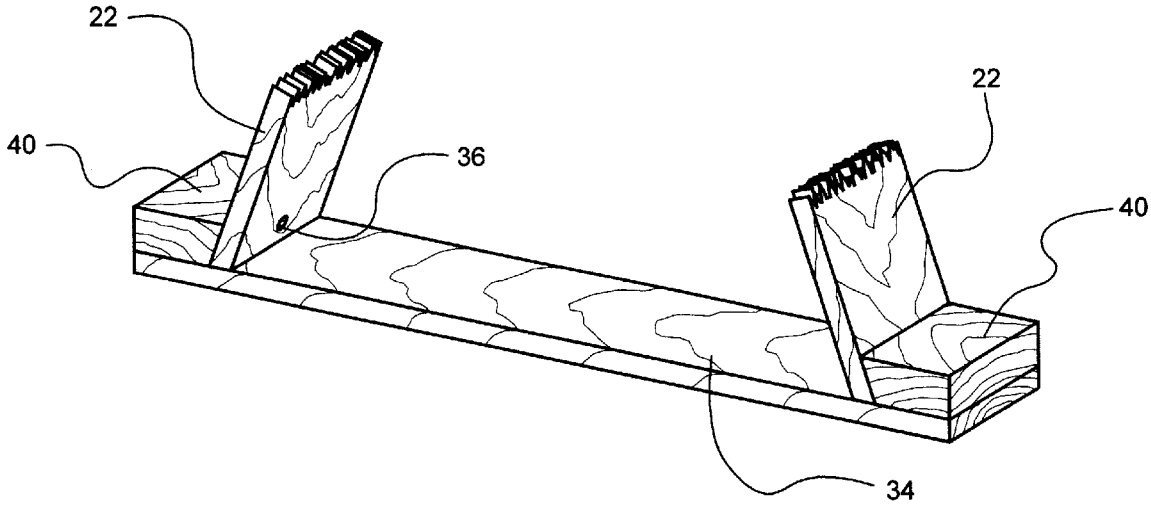
FIG. 6*a* shows a perspective view of the union of the sawhorse and a base.
Figure 6B:
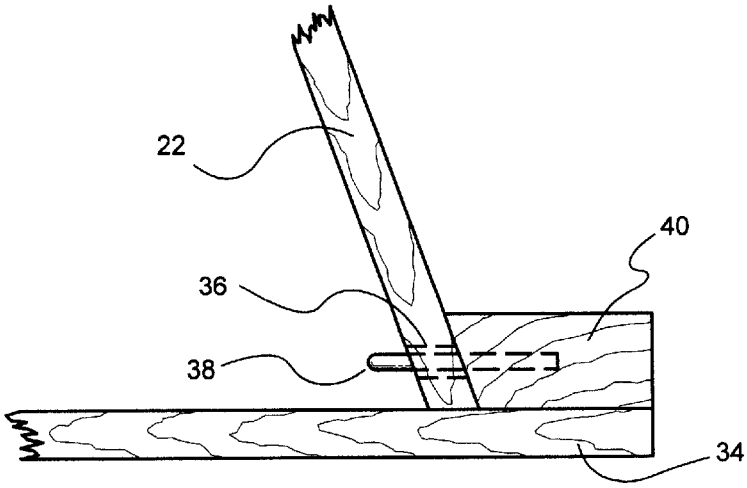
FIG. 6*b* shows a side view of the union of the sawhorse and a base.
Figure 6C:
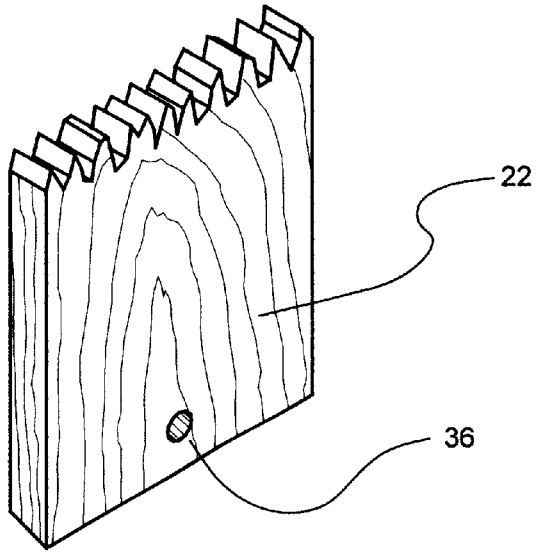
FIG. 6*c* shows a side view of the union of the sawhorse and a base.
Figure 6D:
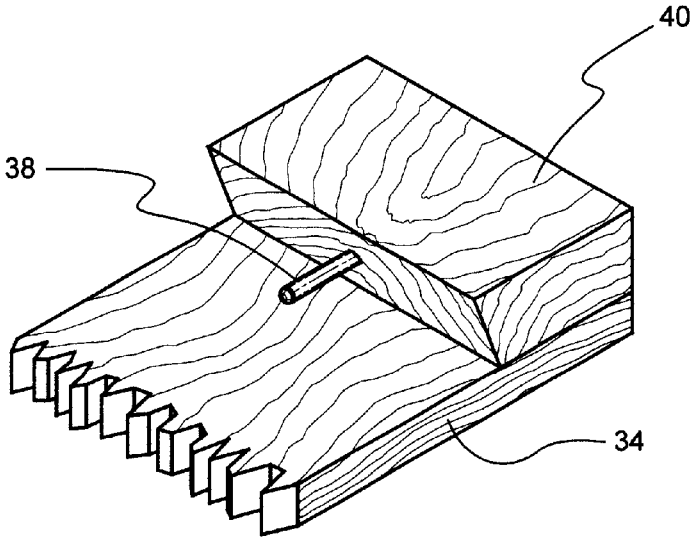
FIG. 6*d* shows the base and a protruding holding pin.

Folding sawhorses are used as warning or barricade devices. The present invention can be used as a barricade or warning device and with the addition of a base as illustrated in FIG. 6*a*. The base provides additional stability. The same locking feature used to deploy the sawhorse will also attach it to a base 34,40 while the base and sawhorse remain easy to transport and store. The mating of the sawhorse vertical member 22 and the base are shown by FIG. 6*b* where a pin 38 protruding from the base fits into a hole 36 placed near the bottom of the sawhorse's vertical members 22. FIG. 6*c* shows the bottom of the vertical member 22 with hole 36 for accepting the pin 38 from the base. FIG. 6*d* shows the base member with the pin 36 used to ensure the vertical members of the sawhorse remain mated to the bases.

Also, this embodiment using the sawhorse with a base member overcomes the problems encounter when working on ground surfaces which are too wet or unleveled.

Figure 7A:
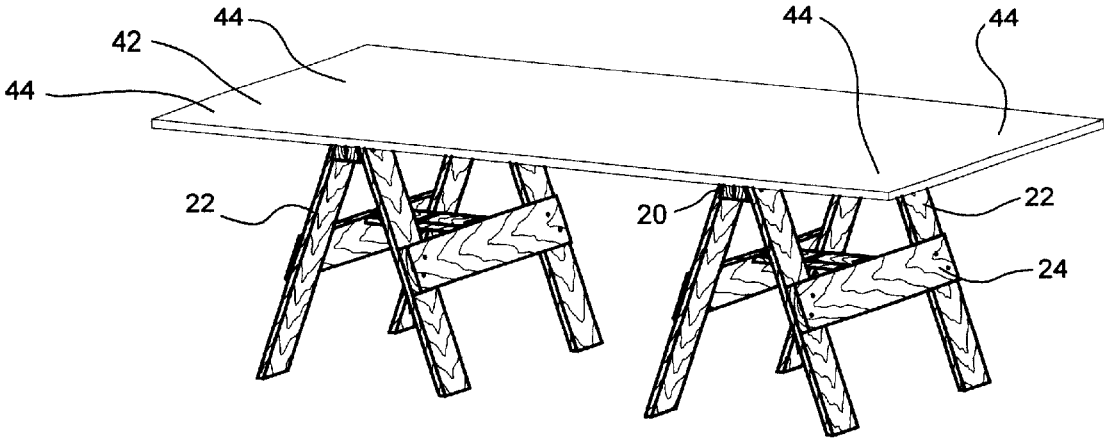
FIG. 7*a* shows an example of a rigid work surface used with two sawhorses to make a rigid and locked worktable.
Figure 7B:
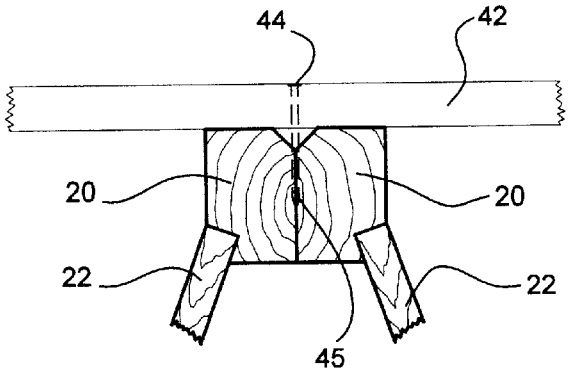
FIG. 7*b* shows how a rigid surface is held by the top jaws of the sawhorse.

Another alternative embodiment is illustrated in FIG. 7*a* showing the use of two sawhorses and a rigid top surface 42 to assemble a table. The table surface attaches to the sawhorses using four countersunk screws 44 as depicted FIG. 7*b*. Since the sawhorse's top member 20 compresses, the screws are held securely and two locked sawhorses and the top 42 become a fixed and rigid worktable.

Figure 8:
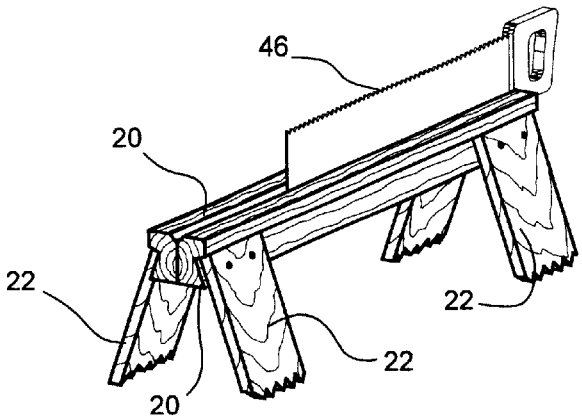
FIG. 8 shows an example using the sawhorse for holding a handsaw.

This invention's locking jaws in the top member 20 provides compression and holding capability when the sawhorse is in the locked position. The jaws of the top member 20 act as a clamp and hold items placed between the jaws. FIG. 8 illustrates the use of the sawhorse as a holder for working on materials placed in the jaws. FIG. 8 shows the use of the sawhorse to hold a hand saw 46 for sharpening.

Many of the sawhorses made that are foldable don't provide a top member where guides or clamps can't be easily employed. In the locked position this invention's top member 20 provides a shape making it easy to employ a guide or clamp as illustrated in FIG. 9*a* for employing guides and FIG. 9*b* for employing a clamp.

Figure 9A:
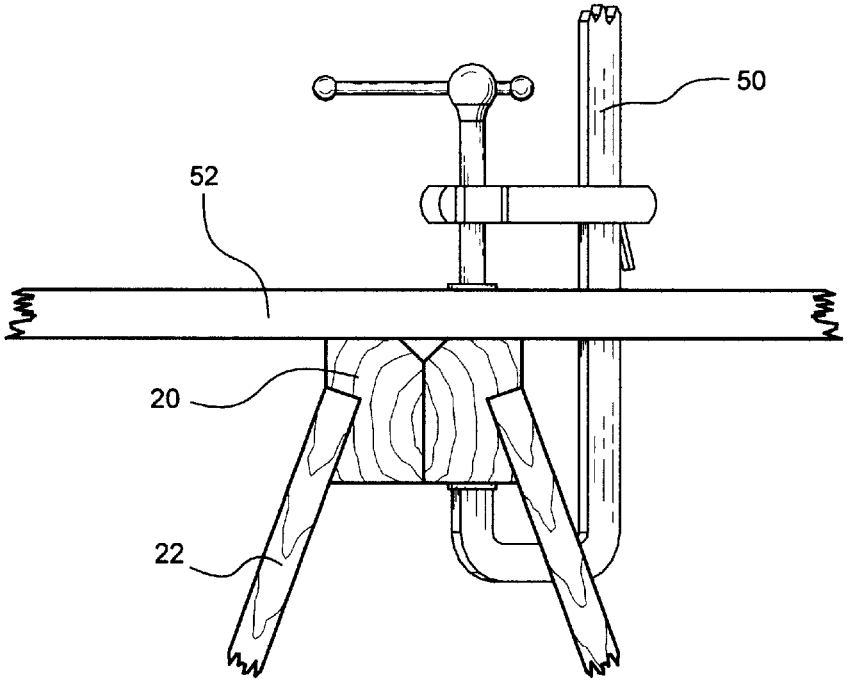
FIG. 9*a* shows an example of using guides for holding materials.

FIG. 9*a* shows how the locking jaws can accept thin plates as guides 48, which keep materials from slipping. The guides 48 can be adjusted by unlocking the sawhorses locking lever 26 and repositioning.

Advantages

From the description above, a number of advantages of my foldable locking sawhorse become evident;

(a) A sawhorse that is easy to build with a minimum of components, but still provides a foldable sawhorse, which is convenient to use and store. Under load the sawhorse design places most the load upon the members and not the connecting mechanisms such as the hinges and screws.

(b) The sawhorse remains rigid while in use as if it were a fixed structure providing a steady sawhorse due to the use of two opposing forces to induce a counterbalance of locking forces.

(c) The lightweight design makes to sawhorse easily transportable or carried and the construction material can vary from wood, plastic, metal or a combination of the three without losing the benefit of the interlocking forces.

(d) The sawhorse's design gives it easy adaptation to other uses such as a traffic-warning device or to support a work surface.

(e) The holding capabilities of the sawhorse allow many more uses for holding work.

(f) Once locked into position, the sawhorse will remain fixed and rigid not allowing loading changes to cause shifting or wobbling.

OPERATIONS—FIGS. 3A, 3B, 6A, 7A, 8, 10A and 10B

The manner of using the sawhorse is identical to using a sawhorse constructed with fixed rigid members that is not foldable. Namely, the sawhorse is opened upon being carried to a location by gently squeezing the top member 20 and dropping the sawhorse into place (FIG. 3A). The sawhorse is made rigid by pressing down on the locking lever 26 until horizontal (FIG. 3B). When in the horizontal position, the locking lever 26 remains looked due to the opposing force on it exerted by the top member 20.

While in the locked position, the sawhorse can be used or moved as if moving a rigid non-foldable sawhorse.

To remove the sawhorse from a work location, one first pushes up on the locking lever 26 to unlock the rigid locked state and picks the sawhorse from the ground by the top member 20 which causes the sawhorse to automatically go to a folded position.

The sawhorse used as warning or barricade device by the addition of a base 34 to the vertical members 22 shown in FIG. 6A is accomplished by opening the sawhorse while on two bases. The pins 38 of the bases fit into the holes of the vertical members 22 and the bases are then connected to the sawhorse. When the sawhorse locks, the bases remain attached until the sawhorse in unlocked. The pins 38 ensure the mating of the sawhorse and bases remain attached when the sawhorse is moved while in the locked position.

In FIG. 7A, the drawing shows how two sawhorses can hold a rigid surface to create a worktable. The rigid table 42 is placed on two unlock sawhorses with the screws 44 protruding from the tabletop fitting between the jaws of the sawhorses top members 20. The locking levers 26 of the sawhorses are pushed down and the two sawhorses lock onto the screws 44 holding the tabletop 42. The three lock together and provide a stable worktable.

The sawhorse becomes a valuable tool for holding work or work tools when needed. FIG. 8 shows an example of a handsaw 46 being held by the sawhorse. The sawhorse can hold other items as it does the handsaw 46.

DETAILED DESCRIPTION OF THE INVENTION

Accordingly, the locking feature of this invention can easily transform a foldable sawhorse in a rigid sawhorse simply and efficiently by using the application of two opposing forces. In addition, one can see that this invention remains rigid and won't wobble while in the open lacked position, yet allows one to employ the sawhorse with little procedure or difficulty. Furthermore, the locking foldable sawhorse has the additional advantages in that

- it permits it's user to easily carry and deploy using a single hand without the need for excessive procedures for set up and use,
- it maintains a fixed rigid form while in use just like a non-foldable unit, yet remains lightweight, strong and foldable,
- it allows heavy loading of the structure without deforming due to the design's use of the main structural member abutments for load bearing instead of the folding devices,
- it permits the use of the sawhorse for use as a barricade or warning device with or without the addition of it base member. The open locked position of the sawhorse makes it resistant to wind or position changes,
- it permits the use of the sawhorse and base to overcome the problems associated with working on wet or unleveled ground,
- it permits the use of the sawhorse as a platform for creating a rigid worktable using the locking ability of the top member for attaching to a tabletop,
- it allows the user to employ the sawhorse as a clamp for holding materials or tools.

It permits the use of guides and hand clamps to hold materials by insertion into the jaws or by applying clamps directly to the top of the sawhorse.

In operation, a locking foldable sawhorse device 10 is carried in a folded position by an individual to a job site whereupon opposing legs 22 of the device 10 are separated until opposing jaw members 12 of the top member 20 or elongated split beam engage thereby originating the device 10 in an "opened" position. The device 10 is stabilized and "locked" by forcibly positioning a locking lever 26 such that opposing side walls 14 of the locking lever 26 engage as illustrated in FIG. 11). In the locked position, the lever 26 is prevented from "folding" downward to form a "V" configuration due to the lower hinge 30 holding the two side walls 14 of the two portions of the lever 26 together thereby using the abutting side walls 14 to limit downward movement and allow only upward movement of the lever 26 from the locked position. Thus, the present device 10 is differentiated from the prior art devices that utilize bracing members that collapse either upward or downward and are at best limited in a downward direction by adjacent members of the prior art device such as the step or rung of a ladder placed proximate to and beneath a bi-directional, movable brace.

When relatively "light" loads are set upon an elongated split beam 20, the legs 22 may be joined to opposing planar side walls 15 of the beam 20 via screws or similar attaching means. The side walls 15 forming a right angle with corresponding planar bottom walls 16 of the beam. Alternatively, the side walls 15 may be inclined such that an acute angle is formed with the bottom walls 16 thereby configuring the legs 22 so that bottom end portions 8 that engage the ground are separated a greater distance than top end portions 19 to provide a stable base for the device 10. When the device 10 is used to support relatively "heavy" loads, the stability of the device 10 is increased by including a groove 21 in each side wall 15 of the beam 20. The groove 21 provides a support wall 17 and a connection wall 18 that form an obtuse angle. The walls 17 and 18 cooperatively engage top end portions 19 of the legs 22 as illustrated in FIGS. 1A and 3D, whereby the legs 22 are angled with respect to the upper surface of the beam 20, and the legs 22 support the beam 20 via an end wall 13 that engages the support wall 17, and a side wall 11 that engages and is joined to the connection wall 18.

A table may be fabricated from two locking foldable sawhorse devices 10 and a rigid surface 42 such a plywood. The surface 42 is secured to the devices 10 by countersinking screws 44 through the surface 42; the screws 44 ultimately being secured between opposing jaw members 12 of the device 10. When a relatively "light" load is placed upon the surface 42, the screws 44 need only be "pinched" between the jaw members 12. The inherent flexibility of the materials (wood, fiberglass, plastics and some metals) used to fabricate the device, allow the locking lever 26 to be positioned such that the side walls 14 of the locking lever 26 engage thereby locking the position of the device 10, while allowing the jaws members 12 of the beam 20 to remain separated a distance corresponding to the diameter of the screws 44. Although the top portion of the beam 20 supporting the surface 42 will form an inverted "V" when taking a side elevation view of the device 10, sufficient stability will be provided due to the locked lever 26 and a relatively small distance separating the jaw members 12 due to the screws 44 having a small diameter. Should a relatively "heavy" load be placed upon the surface 42, threaded recesses 45 would be provided that would removably receive the screws 44 therein to allow the jaw members 12 of the beam 20 to engage thereby providing a beam 20 with a planar top portion to support the surface 42, and providing a device 10 having increased stability to withstand the heavier load.

Figure 9B:
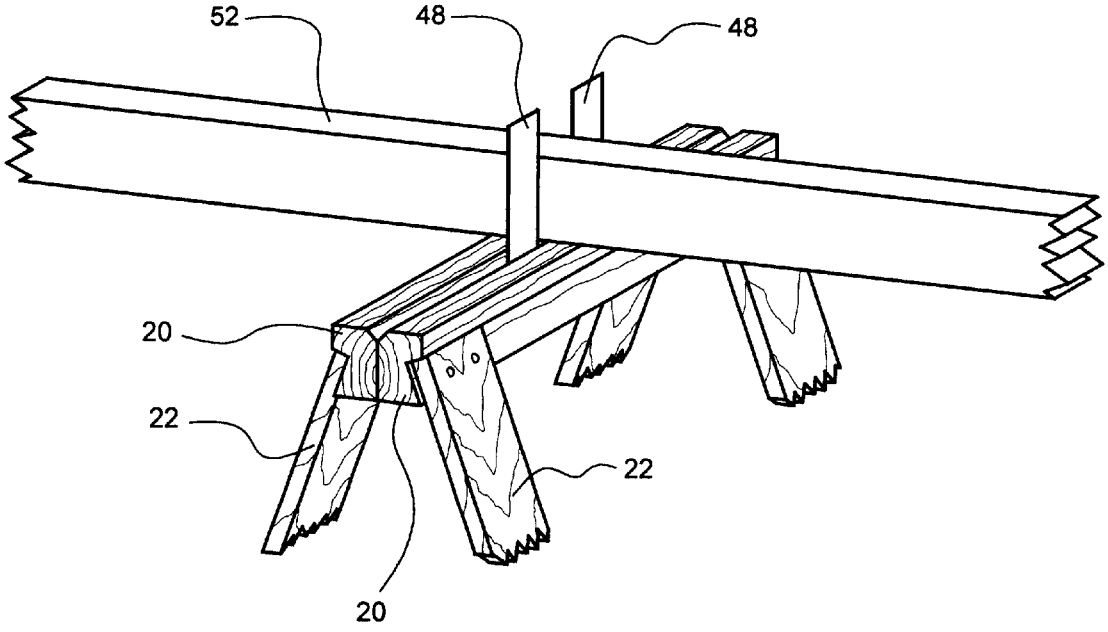
FIG. 9*b* shows the use of a hand clamp.
Figure 10A:
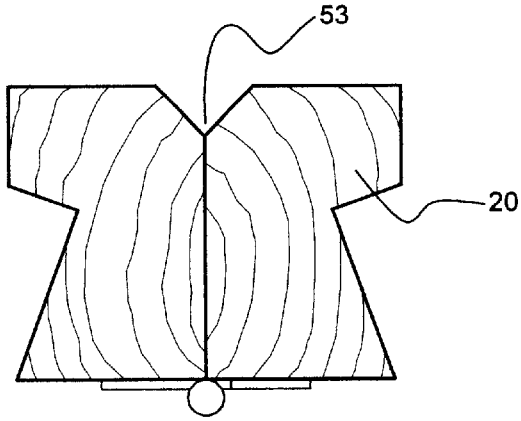
FIG. 10A is an end view of the spit beam in a locked position.
Figure 10B:
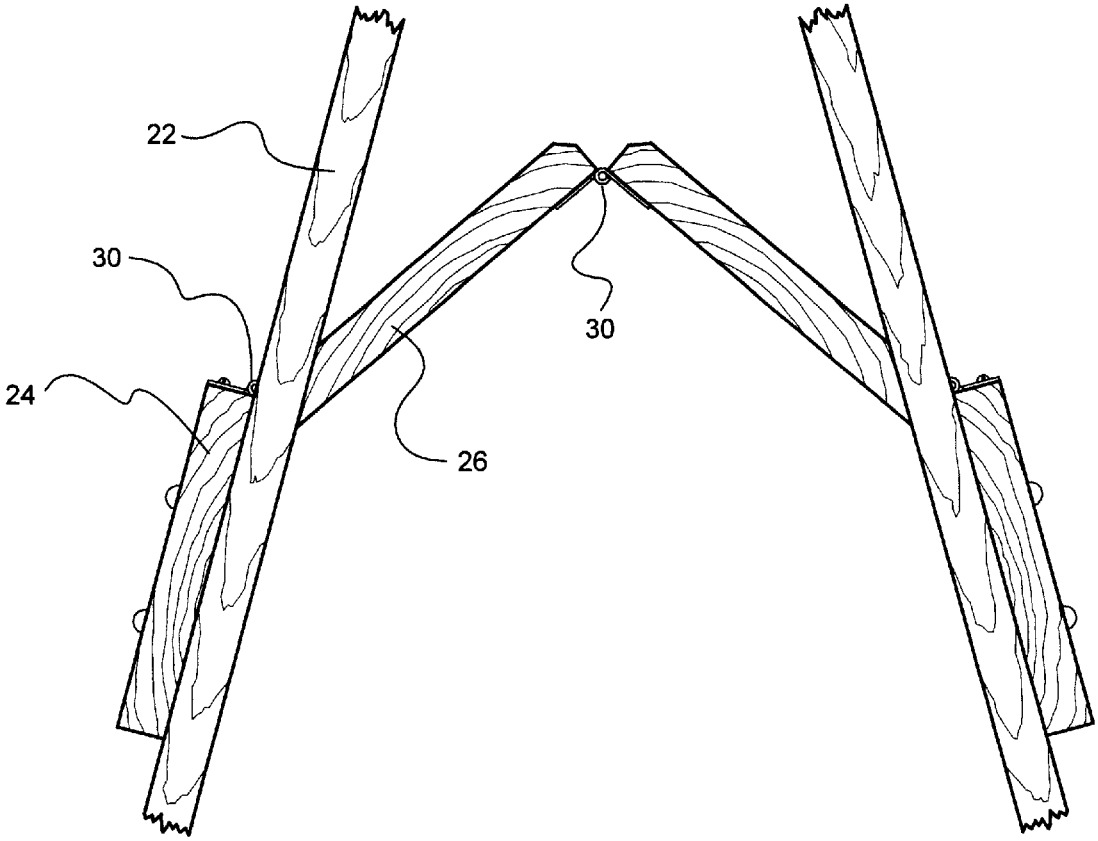
FIG. 10B is an end view of the hinged locking lever in an unlocked position.

The inherent flexibility of the device 10 and the pinching feature of the jaw members 12 of the beam 20 may be utilized to hold relatively "thin" objects therebetween. For example, a hand saw 46 requiring sharpening could be positioned between the jaw members 12, then locked in position by the locking lever 26 with sufficient stability to allow sharpening tools to be forcibly applied to the hand saw 46. Further, flat plates 48 may be locked between the jaws 12 to maintain the position of a workpiece 52, such as a board or pipe, upon the beam 20. Also, a clamp 50 may be included to further stabilize the workpiece 52 upon the beam 20 as illustrated in FIG. 9B. When utilizing the clamp 50, the beam 20 should have a planar top surface which correspondingly requires the jaw members 12 to be positioned together.

Figure 11A:
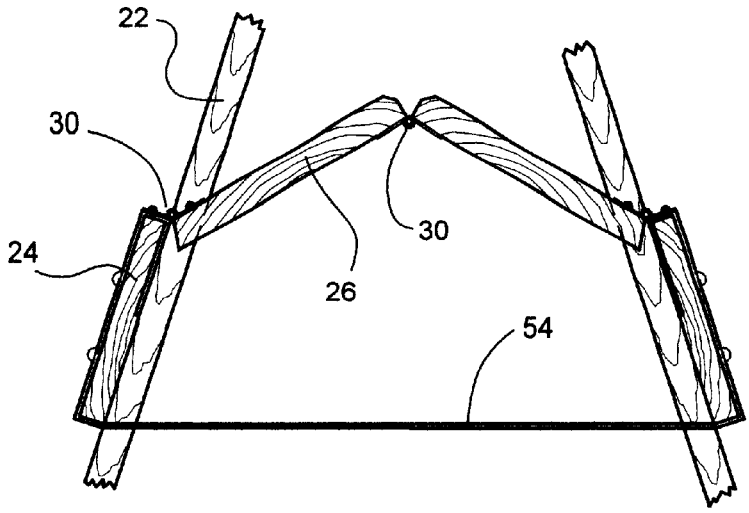
FIG. 11A is an end view of the device with a safety line secured thereto in accordance with the present invention.
Figure 11B:
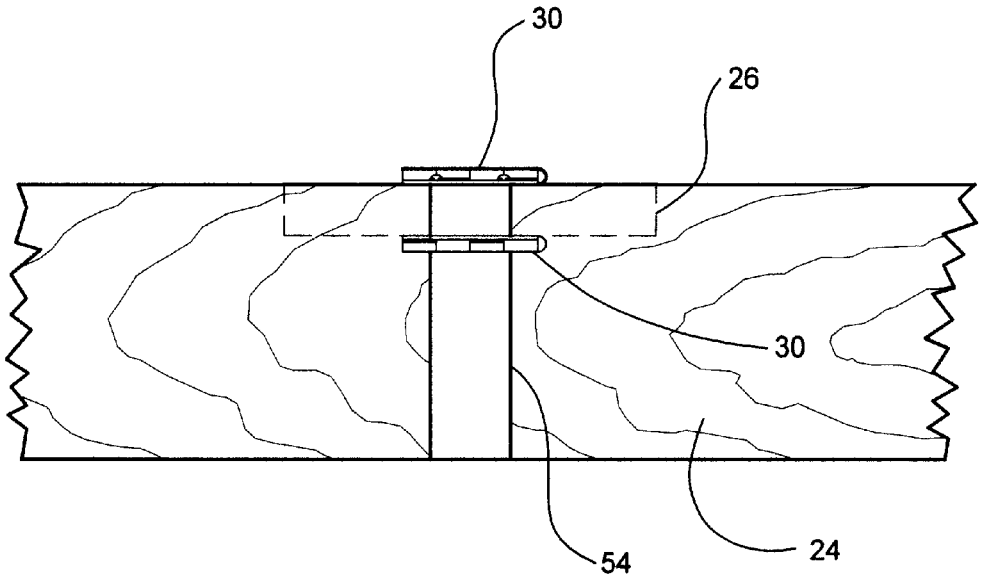
FIG. 11B is a side view of the safety lines shown in FIG. 11A.

Referring now to FIGS. 11A and 11B, the device 10 is alternatively designed to include a safety line 54 attached to the horizontal member brace 24 via the small hinges 30 that join the hinged locking lever 26 to the member brace 24. The safety line 54 may be fabricated from a myriad of materials including but not limited to nylon, polyester strapping, steel cable or nylon cord—the preferred material. The line 54 ensures that the legs 22 will not spread beyond a predetermined limit the thereby protecting the locking lever 26 from being over extended and forcibly removing the hinges 30 from the brace 24. The safety line 54 protects the locking lever 26 without interfering with the operation of the lever 26 due to the hinges 30 collapsing the lever 26 away from the safety line 54.

Figure 12:
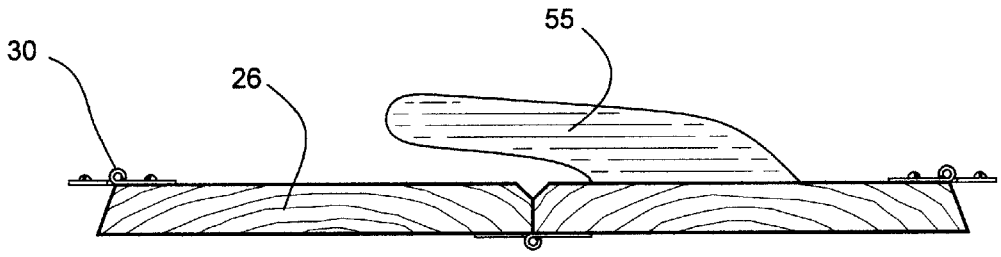
FIG. 12 is an end view of a locking lever with a handle secured thereto in accordance with the present invention.

Referring to FIG. 12, the locking lever 26 of the device 10 is depicted with a handle 55 attached to one side of the lever 26 to allow an user to lock and unlock the lever 26 without the risk of the user's fingers being "pinched" between the cooperatively engaged side walls 14 of the lever 26 as the legs 22 of the device 10 are spread apart or brought together during normal operation.

Figure 13A:
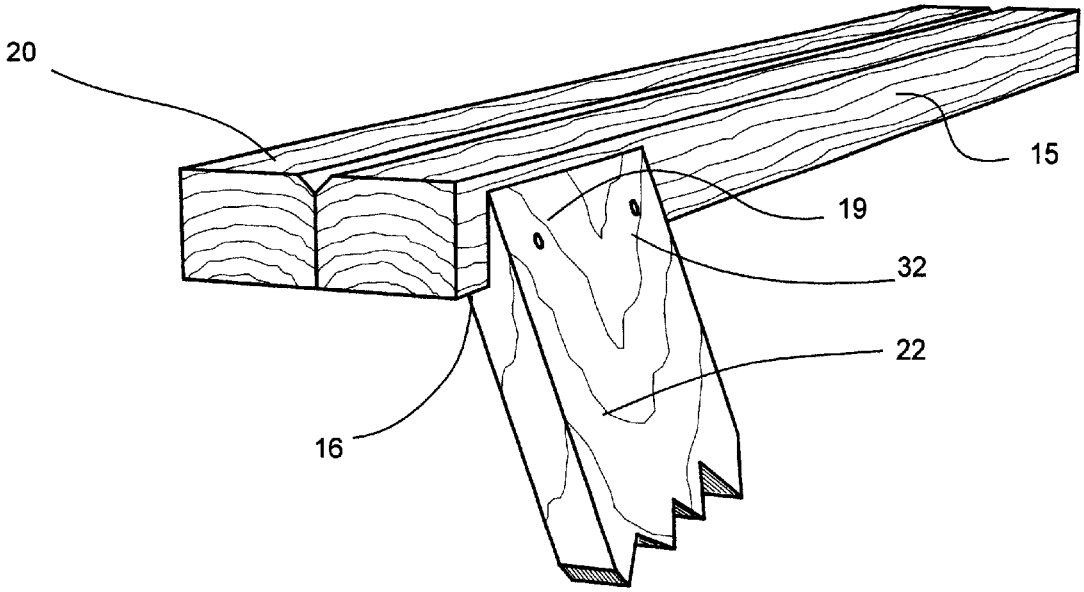
FIG. 13A is a perspective view of an alternative design for a leg member in accordance with the present invention.
Figure 13B:
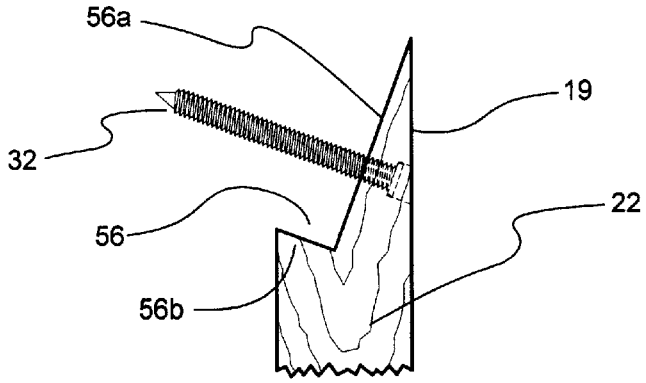
FIG. 13B is a side view of the leg member of FIG. 13A.
Figure 14A:
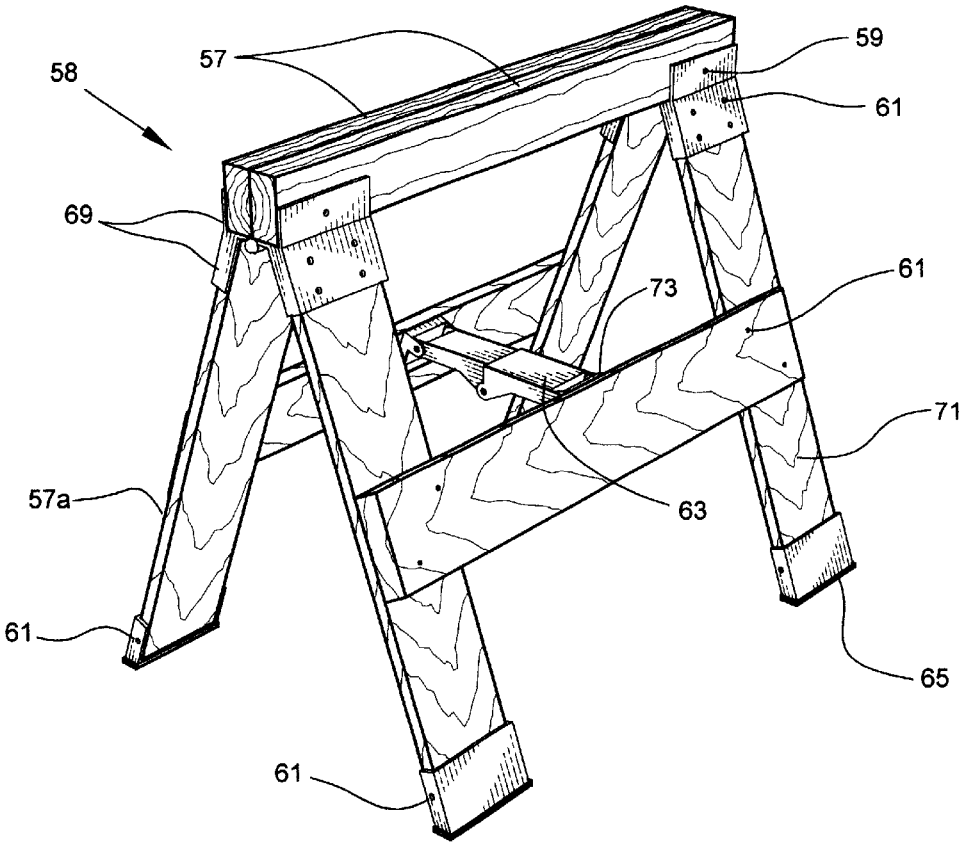
FIG. 14A is a perspective view of an alternative design of a locking foldable sawhorse in accordance with the present invention.
Figure 14B:
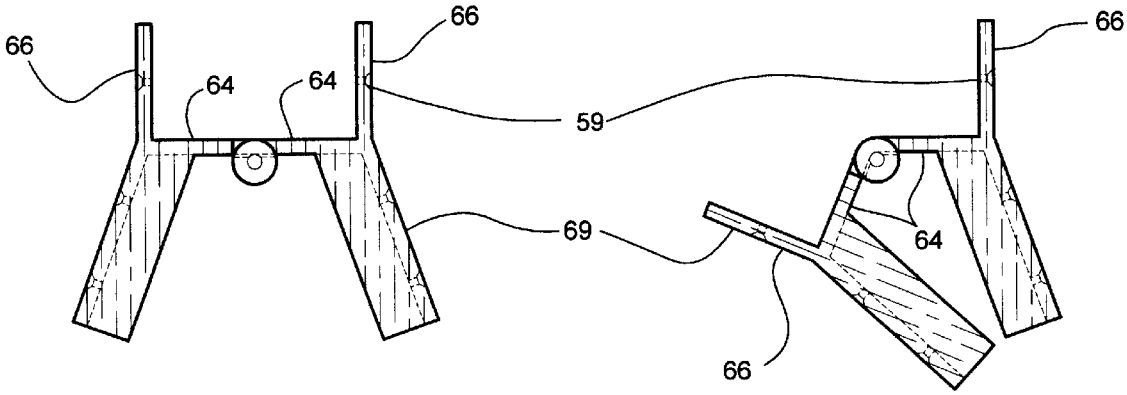
FIG. 14B are two end views of two pivotally joined leg connectors shown in loaded and unloaded positions in accordance with the resent invention.
Figure 14C:
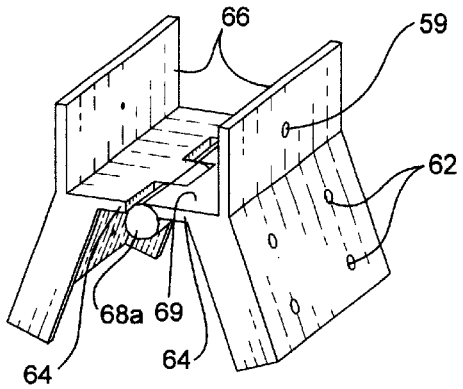
FIG. 14C is a perspective view of the leg connector of FIG. 14B.
Figure 14D:
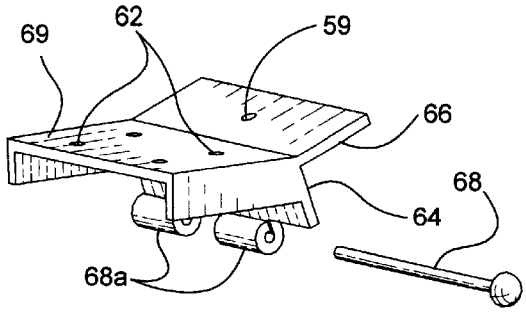
FIG. 14D is a perspective view of a single leg connector of FIG. 14C.
Figure 14E:
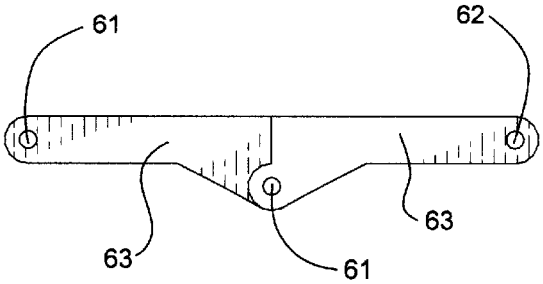
FIG. 14E is an end view of a locking lever included in the device of FIG. 14A.
Figure 14F:
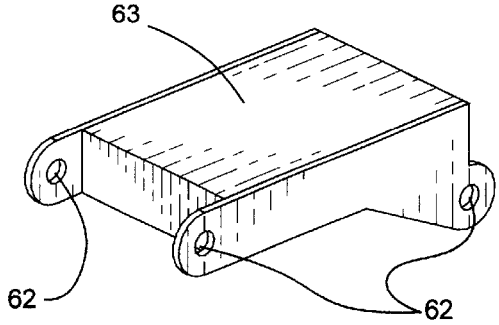
FIG. 14F is a perspective view of the left portion of the locking lever of FIG. 14E.
Figure 14G:
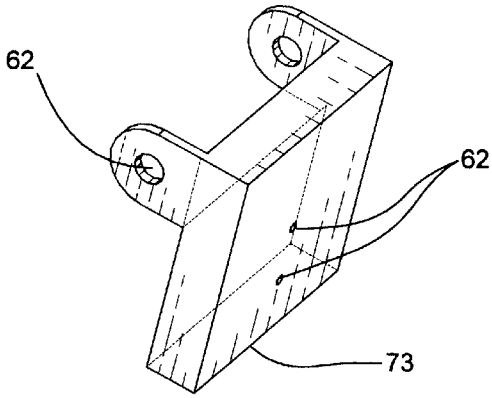
FIG. 14G is a perspective view of a mating connector which ties the locking lever to a horizontal brace.
Figure 14H:
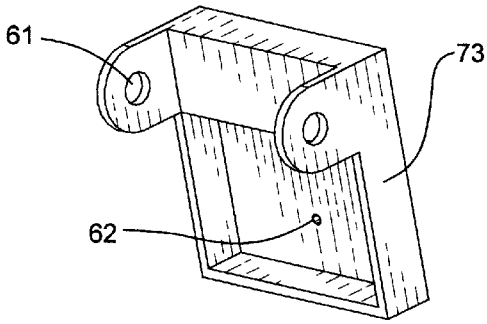
FIG. 14H is a different perspective view of the mating connector of FIG. 14G.
Figure 14I:
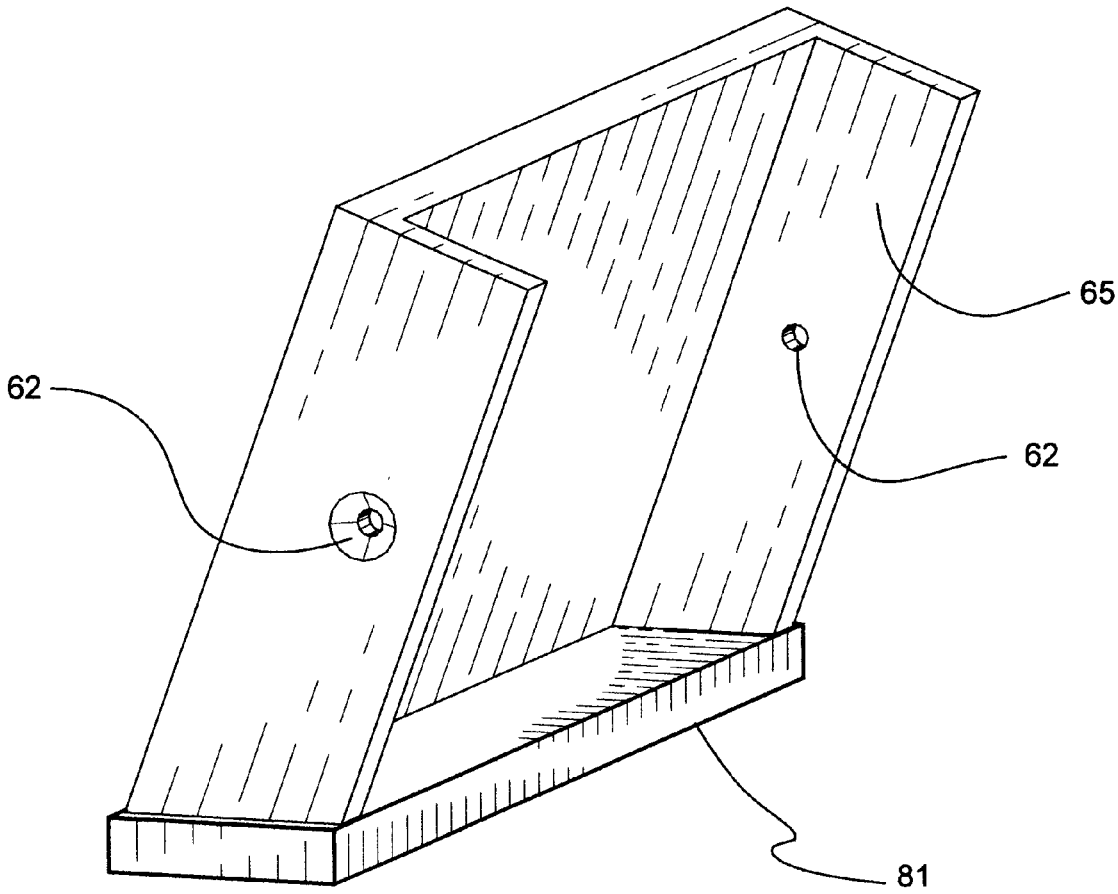
FIG. 14I is a perspective view of a leg bottom connector.

Referring now to FIGS. 13A and 13B, the elongated split beam 20 of the device 10 is depicted with an alternatively designed leg 22. Instead of a groove 21 in the beam 20 forming support and connection walls 17 and 18 which join to form an obtuse angle that cooperatively receives a top end 19 of the leg 22, a recess 56 is provided in the top end 19 of the leg 22. The recess 56 includes a connection wall 56*a* and a support wall 56*b* which are configured to form an obtuse angle. The connection wall 56*a* engages the side wall 15 of the beam 20 while the support wall 56*b* engages the bottom wall 16 of the beam 20. The top end 19 of the leg 22 is secured to the beam 20 via screws 32 inserted through the top end 19 and continuing perpendicularly through the connection wall 56*a* while engaged with the side wall 15, and extending into the beam 20 a distance sufficient to provide stability to the assembled device 10 when a load is set thereupon.

Referring to FIGS. 14A–14I, an alternative sawhorse 58 is depicted that includes one or more removable beams 57 set upon a beam support structure 57*a*. The beams 57 and support structure 57*a* may be fabricated from a myriad of materials including but not limited to wood, metal, fiberglass and plastic. The preferred material of fabrication for the beams 57 is wood. The preferred material of fabrication for the support structure 57*a* is fiberglass channel joined together with metal. The support structure 57*a* includes two sets of two pivotally joined leg top connectors 69 that are attached to four corresponding top ends of four leg members 71 via rivets 61 forcibly inserted through orifices 62. The support structure 57*a* further includes metal, horizontal braces 63 joined to mid-portions of adjacently positioned fiberglass legs 71 on each side of the structure 57*a*, and metal leg bottom connectors 65 attached to bottom ends of the four leg members 71 via rivets 61 forcibly inserted through orifices 62. The support structure is attached to the beams 57 via screws 32 through orifices 59 in connectors 69.

The leg top connectors 69 are relatively "Y" configured when taking an end view of the device 58, have first arm members 64 shorter longitudinally then second arm members 66, and are pivotally joined via relatively long rivets 68 inserted through aligned, alternately positioned, hinge loops 68*a* joined to the end of the first arm members 64. The connectors 69 form a rectangular configuration when taking an end view of the device 58 in a stable, load bearing position. The respective lengths of the first and second arm members 64 and 66 are dependant upon the quantity and size of the beams 57 to be snugly inserted between the arm members 64 and 66.

The metal locking levers 63 are pivotally coupled together and are secured to an inside wall of the horizontal brace 67 via a mating connector 73 by utilizing rivets 61 and orifices 62. The locking levers 63 function in the same manor as described above for the hinged locking lever 26 when stabilizing the sawhorse device 10. The bottom connectors 65 include a rubber pad 81 joined to an inclined bottom portion that positions the pad 81 in congruent engagement with the surface supporting the device 58 when the legs 71 of the device 58 are spread and locked in a load bearing or open position. The safety line 54 described above for the sawhorse device 10 may also be included for the alternative device 58. The alternative device 58 would have the safety line 54 joined to the mating connectors 73 such that the locking levers 63 would be above and parallel to a taught line 54 when the device 58 was in an open position. The levers 63 would angle away from the line 54 when the legs 71 of the device 58 are brought together.

The aforementioned locking levers 26 and 63 are not limited to sawhorse devices 10 and 58, respectively, but may be utilized with any collapsible support device such as ladders, signs, scaffolding, pipe stands and the like that include pivotally joined leg or "V" configured support members. Generally, the locking levers 26 or 63 form a "triangle" that includes the pivot point and portions of the leg members joined thereto whereby the collapsible support device is stabilized and locked in an open position until the support device is relocated to another job site or placed in storage.

The foregoing description is for purposes of illustration only and is not intended to limit the scope of protection accorded this invention. The scope of protection is to be measured by following claims, which should be interpreted as broadly as the inventive contribution permits.

What is claimed and desired to be secured by Letters Patent of the United States is:

1. A locking foldable sawhorse device comprising:
   - a support member having pivotally joined opposing portions;
   - leg members attached to said opposing portions;
   - means for locking said leg members in a predetermined position; and
   - means for securing a workpiece between said opposing portions, said securing means includes flexible fabrication material for promoting the deformation of said opposing portions to facilitate the holding of the workpiece between said opposing portions.

2. The device of claim 1 wherein said support member includes an elongated split beam.

3. The device of claim 1 wherein said support member includes opposing jaw members that engage when the device is in an open position.

4. The device of claim 3 wherein said jaw members are pivotally separated when the device is in a closed position.

5. The device of claim 1 wherein said support member includes means for joining said leg members to said support member.

6. The device or claim 5 wherein said joining means includes an angled recess that receives a top end of said leg members therein.

7. The device of claim 6 wherein said angled recess includes an obtuse angled recess having supporting and connecting walls configured to cooperatively engage corresponding walls of said top end portion.

8. The device of claim 1 wherein said locking means includes a locking lever joined to said members.

9. The device of claim 8 wherein said locking means includes a brace member.

10. The device of claim 9 wherein said locking lever includes opposing portions that are hinged to said brace member.

11. The device of claim 10 wherein said opposing portions are pivotally joined.

12. The device of claim 11 wherein said opposing portions are joined together via a hinge, said hinge being positioned upon cooperating lower surfaces of said locking lever.

13. The device of claim 12 wherein said opposing portions include side walls that are congruently engaged together when the device is in an open position, said side walls cooperating with said hinge to prevent downward movement of said locking lever with the device in the load position.

14. The device of claim 13 wherein said side walls are pivotally separated when said device is in an unloaded position.

15. The device of claim 8 wherein said locking lever includes beveled edges to avoid the pinching of fingers between pivoting opposing side walls.

16. The device of claim 1 wherein said locking means includes a safety line.

17. The device of claim 1 wherein said locking means includes a handle.

18. The device of claim 1 wherein said leg members include a top end having an angled recess therein that cooperates with corner walls of said support member to provide stability when a load is set upon said device.

19. The device of claim 1 wherein said support member includes jaw members capable of securing therebetween a protuberance.

20. The device of claim 19 wherein said jaw members are ultimately pivoted together to secure at least one of said protuberance joined to a workpiece.

21. The device of claim 20 wherein said support member includes recesses that snugly receive said protuberance therein to allow said jaw members to be congruently engaged together.

22. The device of claim 19 wherein said jaw members include said means for securing objects therebetween while said leg members are in a locked position.

23. The device of claim 1 wherein said support member is detachably secured to said leg members.

24. The device of claim 1 wherein said support member includes beveled edges to avoid the pinching of fingers between said pivoting opposing portions.

25. A collapsible load bearing device comprising:

at least one removable beam;

a beam support structure having two sets of two pivotally joined leg top connectors attached to leg members, said pivotally joined leg top connectors having a substantially "Y" configuration that includes a first arm member that is shorter longitudinally than a second arm member; and means for maintaining a predetermined position of said pivotally joined leg top connectors.

26. The device of claim 25 wherein said connectors form a rectangular configuration when a beam is snugly received between said first and second arm members.

27. The device or claim 26 wherein said first arm members of said connectors including hinge loops joined to an end of said first arms, said loops being alternately positioned and aligned to snugly receiving a rivet therethrough to pivotally secure two connectors together.

28. The device of claim 25 wherein said maintaining means includes a locking lever.

29. The device of claim 28 wherein said locking lever is joined to said leg members via a substantially horizontal brace.

30. A locking foldable sawhorse device comprising:

a support member having pivotally joined opposing portions, said support member includes jaw members having means for pinching objects therebetween while said leg members are in a locked position, said pinching means include a device fabricated from flexible material;

leg members attached to said opposing portions; and means for locking said leg members in a predetermined position.

31. A locking device for maintaining a predetermined position of a collapsible support member comprising:

first and second members pivotally joined together;

means for pivotally joining a portion of said first member to a first leg;

means for pivotally joining a portion of said second member to an opposing second leg;

means for promoting the pivoting of said joined first and second members in a predetermined first direction;

means for limiting the pivoting of said joined first and second members in a predetermined second direction; and means for securing a workpiece between said first and second members, said securing means includes flexible fabrication material for promoting the deformation of first and second members device to facilitate the maintaining of the workpiece between said first and second members.

* * * * *